United States Patent [19]

Bauer

[11] 4,370,143

[45] Jan. 25, 1983

[54] PROCESS FOR TREATMENT OF POLYESTER FABRICS

[75] Inventor: Jackson Bauer, Croydon, Pa.

[73] Assignee: Collins and Aikman Corp., New York, N.Y.

[21] Appl. No.: 243,249

[22] Filed: Mar. 12, 1981

[51] Int. Cl.[3] ..... D06M 1/02; D06P 5/22

[52] U.S. Cl. ..... 8/493; 8/115.5; 8/115.6; 427/322

[58] Field of Search ..... 8/115.5, 115.6, 493; 427/322

[56] References Cited

U.S. PATENT DOCUMENTS

| | | | |
|---|---|---|---|
| 3,416,952 | 12/1965 | McIntyre et al. | 8/115.6 |
| 3,535,141 | 10/1970 | Marco | 427/322 |
| 3,557,039 | 1/1971 | McIntyre et al. | 260/29.2 |
| 3,598,514 | 8/1971 | Sello et al. | 8/115.6 |
| 3,598,515 | 8/1971 | Moore et al. | 8/115.6 |
| 3,644,081 | 2/1972 | Matsuda et al. | 8/115.6 |
| 4,113,430 | 9/1978 | Otto | 8/115.5 |
| 4,170,557 | 10/1979 | Marco | 252/8.6 |
| 4,270,913 | 6/1981 | Tse | 8/115.6 |

OTHER PUBLICATIONS

Gagarine, D. M., Textile Chem. & Colorist, vol. 10, No. 12, pp. 13–15, (12/78).

*Primary Examiner*—Maria Parrish Tungol
*Attorney, Agent, or Firm*—Paul and Paul

[57] ABSTRACT

A process for treatment of polyester fabrics imparts improved characteristics to the fabric, including improved moisture wicking, soil-release, and soil-redeposition properties, and less static cling. The process comprises treatment of the fabric with a caustic solution, preferably in the presence of an appropriate catalyst, followed by the application of a polyester copolymer, the copolymer having both hydrophobic and hydrophilic groups. The process treats the entire fabric, not just the surface, and provides a product sufficiently comfortable to be used for intimate apparel and active sportswear.

14 Claims, No Drawings

PROCESS FOR TREATMENT OF POLYESTER FABRICS

BACKGROUND OF THE INVENTION

This invention discloses a process for treating polyester fabrics so as to improve their moisture wicking, soil-release, soil-redeposition, and anti-static characteristics.

Although polyester fabrics have been used successfully in the manufacture of clothing, for a long time, such fabrics have several disadvantages. Polyester fibers do not have the excellent moisture wicking properties of cotton yarns. That is, moisture deposited on the polyester fiber tends to remain where it is, and is not easily carried away along the fiber. Fabrics made of polyester feel uncomfortable when worn near the skin because body moisture cannot easily spread and evaporate. Thus, polyester fabric has been used to make fine outerwear, but has been considered unacceptable in the intimate apparel or active sportswear market.

The hydrophobic nature of polyester fiber, which results in its inferior wicking characteristics, also contributes to its poor soil-resistance properties. Since polyester fabrics are both hydrophobic and oleophilic, they tend to pick up oil-based stains which are not easily removed by rinsing. As polyester fabrics also tend to pick up soil during laundering, such fabrics often become increasingly gray after continued washings.

Another disadvantage of polyester is its tendency to cling because of a build-up of electrostatic charges. The tendency toward static cling is another factor that has made polyester fabric unsuitable for the intimate apparel market.

There have been many attempts to solve the above-described problems of polyester fabrics, some of which have been partially successful. One method is to use a finishing agent on the fabric which would impart properties of soil-release, increased water absorbency, and improved anti-static properties. The finishing agents which have been used are essentially copolymers having both hydrophilic and oleophilic groups. The oleophilic groups can be introduced into the polyester fiber such that the hydrophilic groups remain on the surface, thereby imparting the desired properties. The finishing agents have been applied to polyester by padding and drying and heat setting. Finishing agents have also been applied during the dyeing operation, by exhausting the product onto the fiber.

Finishing agents of the type described have been marketed under the name of Zelcon 4730 (by the E. I. duPont Company) and Milease T (by Imperial Chemical Industries). Details of such finishing agents are given in U.S. Pat. Nos. 3,416,952, and 3,557,039.

In particular, as described in U.S. Pat. No. 3,557,039, such a finishing agent can comprise an aqueous dispersion of 10–50% by weight ethylene terephthalate units, together with 50–90% by weight polyoxyethylene terephthalate units, wherein the average molecular weight of the polyoxyethylene units is 1000 to 4000, wherein the molar ratio of ethylene terephthalate to polyoxyethylene terephthalate is in the range of 2:1 to 6:1, the viscosity ratio of the copolymer being between 1.10 and 1.50, and the melting point being above 100° C., as measured by the temperature of disappearance of birefringence.

One disadvantage of copolymers such as Milease-T is that the anti-static property does not remain as the fabric is laundered many times. Of course, a fabric is not useful if its necessary characteristics are not permanent.

Another method of improving the properties of polyester fabrics has been to treat the polyester with sodium hydroxide. A caustic solution would be used to attack the polyester polymer chain chemically, preferably in the presence of a suitable catalyst such as a quaternary ammonium compound. The catalyst, after being exhausted onto the fiber, would provide an affinity for the caustic to attach to the fiber. This treatment results in the formation of carboxyl groups on the surface of the polyester polymer. The carboxyl groups tend to make the polyester fabric more hydrophilic, thereby improving its moisture-wicking, anti-static and other properties. However, the improvement which results from this treatment is not especially great, and the process is somewhat difficult to control, because it is necessary to attack the fiber uniformly, and to stop the process before the fiber is unduly weakened. Also, the caustic treatment gives very little improvement in anti-static properties at low humidities.

SUMMARY OF THE INVENTION

The present invention is a process which comprises elements of both of the processes described above. That is, polyester fabric is first treated, according to the present invention, in a bath containing sodium hydroxide, or potassium hydroxide, in the presence of an appropriate catalyst. This caustic solution is then treated so as to neutralize its alkalinity. In the preferred embodiment, the pH is adjusted further to about 5.0. A polyester copolymer of the type described above is then applied to the fabric. The fabric can then be dyed and rinsed in a conventional manner.

The process according to the present invention therefore combines the two treatments described above, namely the caustic treatment, and the treatment by a copolymer having both hydrophilic and oleophilic groups. It has been found that the combination of these two treatments, in the manner to be more fully described below, provides improved properties in the fabric which would be unattainable by the use of either treatment alone.

Accordingly, it is an object of the present invention to provide a process for treatment of polyester fabric which imparts improved moisture wicking, soil-release, soil-redeposition, and anti-static properties to the fabric.

It is a further object of the present invention to provide a process as described above, which, when applied to a fabric, enables that fabric to be used in the manufacture of intimate apparel or active sportswear.

It is a further object of the present invention to provide a process as described above, wherein the fabric produced by the process retains its desirable properties after repeated washings.

It is a further object of the present invention to provide a process as described above, wherein the process is suitable for use with very thin yarns, of the order of 40 denier.

It is a further object of the present invention to provide a process which enhances the desirable properties of polyester fabrics, wherein the process includes treatment of substantially the entire fabric, and not merely the surface thereof.

Other objects and advantages of the present invention will be apparent to those skilled in the art from a reading of the following detailed description of the invention and the appended claims.

DETAILED DESCRIPTION OF THE INVENTION

The process according to the present invention can be described in qualitative terms as follows. A polyester fabric is first treated, in a water bath, with caustic (sodium hydroxide or potassium hydroxide) and a catalyst, the catalyst preferably being a quaternary ammonium compound. Next, the caustic is removed, and the fabric is kept in the bath. The pH of the bath is adjusted to fall within the acid range, preferably in the range of 4.5–5.5. Next, an appropriate polyester copolymer, having both hydrophilic and oleophilic groups, is added to the bath, and the polyester copolymer is exhausted onto the fabric. At this point, conventional dyeing steps can be performed by adding a carrier, leveling agents, and dye stuff, and by carrying out the dyeing at about 230° F.

Although the invention comprises a caustic treatment followed by a copolymer treatment, the invention is not a mere combination of two previously known steps. In the past, when either the caustic or the copolymer treatment was used, the treatment was concluded by the application of dyes and finishing agents. In the present invention, no finishing is done between the caustic treatment and the copolymer treatment. As will be quantitatively apparent below, the results obtained from the process of the present invention are considerably better than would have been predicted on the basis of its component steps.

The caustic and copolymer components of the process are believed to interact with each other in the following way. During the application of the caustic, the polyester fiber structure is opened by the introduction of carboxyl groups resulting from hydrolysis. The carboxyl groups, as is known from the prior art, make the fabric more hydrophilic. But it is also believed that the opening-up of the polyester fiber structure during the caustic treatment enhances the effectiveness of the next step, namely the addition of the polyester copolymer. This copolymer has both hydrophobic and hydrophilic groups, and the hydrophobic end is thus introduced into the open areas of the polyester fabric, as by adsorption, and not by a chemical bond. The hydrophilic end of the copolymer remains near the surface, and imparts the desired properties to the fabric. Thus, it is believed that the caustic process assists in increasing the effectiveness of the polyester copolymer by enabling the latter to penetrate more deeply and permeate the fabric to produce the desired properties.

Of course, this invention is not to be deemed limited by the above interpretation of the chemical mechanism involved. The above description is given only to suggest a possible explanation of the phenomenon which has been discovered.

This invention is suitable for use with especially lightweight fabrics, making the invention particularly suitable for use in intimate apparel or active sportswear.

The following first five examples describe the procedures used to prepare fabric samples which were used to evaluate the present invention. The actual practice of the present invention is illustrated in Example 4. The other examples show procedures which omit particular parts of the process of the present invention, or which contain other changes. The fabric samples treated according to these examples are compared quantitatively with the fabric treated according to the invention. Example No. 1 shows the procedure for producing a fabric treated with a caustic solution only. Example No. 2 shows a procedure for producing a fabric treated with the copolymer only. Example No. 3 is a procedure for producing an untreated control fabric. Example No. 4, as stated above, represents the process according to the present invention. Example No. 5 is a procedure which combines the caustic and copolymer treatments, but in separate baths, in contrast to the procedure of the present invention.

All of these first five examples were used to produce samples whose properties were evaluated, in various tests. These tests are fully described in Examples 6–9, below.

It is noted that in each of Examples 1–5, no dyes were added to the fabric. However, in each example, it is indicated at what point in the procedure dyes could be added. For purposes of the evaluation of the process according to the present invention, it was desired that the fabrics be white, in order better to observe their properties. Therefore, no dyes were added in producing the samples described. However, it is understood that in each of Examples 1–5, dyes could be added, in the place indicated, without affecting the results. Any dyes suitable for polyester fabrics could be used. It has been found that the presence or absence of the dyes has no effect on the properties of the fabrics tested by the procedures to be described below.

EXAMPLE 1

This example shows the procedure for obtaining a fabric treated with the caustic solution only, and without any copolymer treatment.

A dye machine containing a sample of polyester fabric (Greige Style, R 1822/6) is filled with water at 70°–80° F. In this Example, and in Examples 2–5, the relative amounts of dye bath and fabric are 15 parts dye bath to one part fabric, by weight. A quaternary compound, to assist in the caustic/polyester reaction, is added in the amount of 1 g/l and the bath is allowed to circulate (the circulation being accomplished by a pump) for five minutes. The quaternary compound used is known as BTC 824, which is obtainable from the Refined-Onyx Co. (624 Schuyler Avenue, Lyndhurst, N.J.). BTC is a registered trademark of the afore-mentioned company.

Next, a predissolved caustic soda flake is added to the bath, so that the bath has a concentration of 5 g/l of caustic soda. The bath is allowed to circulate for ten minutes.

The temperature of the bath is then raised to 200° F., at 3° F. per minute. The bath is allowed to circulate for 30 minutes. The bath is then subjected to an overflow rinse, and is cooled to 90° F. The pH of the bath is adjusted to 5.0 with acetic acid, and the bath is allowed to circulate for 5 minutes.

Next, various chemicals are added to the bath. These chemicals are: Permalev PES (a non-ionic dye leveling agent, obtainable from the Refined Onyx Company), in the amount of 4% owf (i.e., on the weight of the fabric). Next there is added a dye carrier, such as trichlorobenzene with an emulsifying agent, in the amount of 4% owf. Next there is added Fancolene ND (a sequestering agent, obtainable from W. F. Fancourt Co. Inc., P.O. Box 20328, Greensboro, N.C.), in the amount of 0.25% owf. Next there is added acetic acid (17%), at a pH of approximately 4.2, in the amount of 0.25% owf. The bath is allowed to circulate for five minutes.

The temperature of the bath is raised to 100° F.

At this point, dyes could be added if desired. In this example, no dyes were added.

The temperature of the bath is raised to 230° F., at 3° F. per minute, and the bath is allowed to circulate for 1 hour.

The bath is cooled to 180° F., and subjected to an overflow rinse. The water is drained, and the fabric is removed from the dye machine, extracted and dried at 320° F., and heat set at 360° F.

EXAMPLE 2

This example shows the procedure used to produce a fabric sample which has been treated with the copolymer, but has not been treated with the caustic solution.

The dye bath, containing a sample of fabric of the type given in Example 1, is set at 90° F. The dye chemicals, Permalev PES, the dye carrier, and the Fancolene ND, are added in the same amounts as stated in Example 1. Also, acetic acid having a pH of about 4.2, is added, and the bath is allowed to circulate for five minutes.

The copolymer Milease-T (described above) in a concentration of 7.0% owf, diluted 5:1 with cold water, is added to the bath.

The pH of the bath should be between 4.5–5.5. The temperature of the bath is raised to 140° F., and the bath is allowed to circulate for 15 minutes.

At this point, dyes could be added to the bath, although in this example, no dyes were used.

The temperature of the bath is raised to 230° F. at 3° F. per minute. The bath is allowed to circulate for 1 hour. The bath is then cooled to 180° F., and subjected to an overflow rinse. The water is drained, and the fabric is removed from the bath, extracted, dried at 320° F., and heat set at 360° F.

EXAMPLE 3

This example describes the procedure which was used for producing an untreated control fabric to be used in testing the results of the present invention.

The bath containing the fabric (of the same type as that given in Example 1) is set at 90° F. The chemicals Permalev PES, the dye carrier, the Fancolene ND, and the acetic acid are added in the same amounts as given in Example 1. The bath is allowed to circulate for five minutes.

The pH of the bath is checked; it should be within 4.5–5.5. The temperature of the bath is raised to 140° F., and the bath is allowed to circulate for 15 minutes.

At this point, dyes could be added, although in this example, no dyes were used.

The temperature of the bath is raised to 230° F., at 3° F. per minute. The bath is allowed to circulate for 1 hour. The bath is then cooled to 180° F. and subjected to an overflow rinse. The water is drained. The fabric is removed from the bath, extracted, dried at 320° F., and heat set at 360° F.

EXAMPLE 4

This example gives the precise procedure used for practicing the present invention. That is, this example includes both the caustic and copolymer treatments, with the proper intermediate steps.

The dye bath containing the fabric (of the same type as that given in Example 1) is filled with water at 70°–80° F. There is added the quaternary compound BTC 824 (the same compound more fully described in Example 1) in the amount of 1 g/l. The bath is allowed to circulate for 5 minutes.

Next, there is added predissolved caustic soda flake so as to make the concentration in the bath 5 g/l of caustic soda. The bath is allowed to circulate for 10 minutes.

The temperature of the bath is raised to 200° F. at 3° F. per minute. The bath is allowed to circulate for 30 minutes. The bath is then cooled to 90° F., and the pH is adjusted to about 5.0, with acetic acid. The bath is then allowed to circulate for 5 minutes.

Dye chemicals (Permalev PES, the dye carrier, Fanoclene ND, and acetic acid in the amount specified as in Example 1) are added to the bath, and the bath is allowed to circulate for 5 minutes.

Next there is added the copolymer Milease-T (described above), in a concentration of 7.0% owf, diluted 5:1 with cold water. The pH of the bath is checked to be sure that it lies in the range 4.5–5.5. The temperature of the bath is raised to 140° F., and the bath is allowed to circulate for 15 minutes.

At this point, dyes could be added. In this example, no dyes were used.

The temperature of the bath is raised to 230° F. at 3° F. per minute. The bath is allowed to circulate for 1 hour. The bath is then cooled to 180° F., and subjected to an overflow rinse. The water is drained from the bath. The fabric is removed, extracted, dried at 320° F., and heat set at 360° F.

EXAMPLE 5

This example gives a procedure for producing a sample fabric which has been treated with caustic and with Milease-T, but in separate baths, in contrast to the single bath used in the method according to the present invention. The purpose of this example is to provide a comparison between the process of the present invention, and the mere combination of the two known procedures, namely the caustic process and the Milease-T process.

A dye bath containing fabric (of the same type used in the previous Examples) is filed with water at 70°–80° F. A quaternary compound BTC 824 (as identified more fully in Example 1) is added in the amount of 1 g/l, and the bath is allowed to circulate for 5 minutes.

Next there is added predissolved caustic soda flake to give the dye bath a concentration of 5 g/l of caustic soda. The bath is allowed to circulate for 10 minutes.

The temperature of the bath is raised to 200° F. at 3° F. per minute. The bath is allowed to circulate for 30 minutes. The bath is then subjected to an overflow rinse, and is cooled to 90° F. The pH is adjusted to 5.0 with acetic acid, and the bath is again allowed to circulate for 5 minutes.

Next the dye chemicals (Permalev PES, the dye carrier, Fancolene ND, and the acetic acid) are added in the same amounts as described in the previous examples, and the bath is allowed to circulate for 5 minutes.

The temperature of the bath is raised to 100° F.

At this point a dye could be added, although no dye was used in this example.

The bath is allowed to circulate for 10 minutes. The temperature is then raised to 230° F. at 3° F. per minute, and the bath is allowed to circulate for 1 hour.

The bath is next cooled to 180° F. and subjected to an overflow rinse. The water is drained from the bath. The dye machine is then refilled with water at 90° F. The pH is adjusted to 5.0 with acetic acid.

There is next added the copolymer Milease-T, having a concentration of 7.0% owf, diluted 5:1 with cold water. The pH is checked; it should lie within the range 4.5–5.5.

The temperature of the bath is raised to 140° F. to exhaust all of the Milease-T onto the fabric. The bath is allowed to circulate for 5 minutes.

The bath is rinsed and drained. The fabric is removed, dried at 320° F., and heat set at 360° F.

The above examples have given the procedures used to produce fabric samples to be tested, so as to evaluate the present invention. For convenience, the fabrics produced according to Examples 1 through 5 will be referred to as Samples 1 through 5, respectively. Thus, a fabric which has been treated in accordance with the present invention is represented by Sample No. 4.

The following examples give the procedures used to perform tests of the samples, together with the results of these tests.

EXAMPLE 6

This example is designed to evaluate the degree to which a fabric releases oil stains. This test is simple, and avoids the variability in stain-release associated with differences among various commercial laundry detergent compositions. The test involves only oil in water at room temperature. A fabric that releases oil in water at room temperature, without the use of a detergent, has excellent oily soil release properties.

In this test, the specimens of each fabric tested should be 3 inches square. A container, about 6 inches in diameter and at least 3 inches deep, is filled with tap water to a depth of at least 2 inches. The water should have a temperature of about 70°–80° F., and its pH should be in the range of 6–7.5.

The fabric specimen is placed on a paper towel. Olive oil, tinted with an oil soluble dye, is placed in a dropper. The dye is used for easier visibility, but the dye should not be capable of staining the fabric to be tested. A suitable dye is Waxolene Red OS (available from Imperial Chemical Industries). Enough oil is applied to cover completely and saturate an area about 1.5 inches in diameter in the center of the fabric specimen. The specimen is allowed to remain on the paper towel for about 2 minutes. The specimen is then transferred to a clean paper towel to blot out lightly any excess oil. The oiled specimen is then transferred to the surface of the water in the container. The specimen is placed flat on the surface of the water.

The specimen is observed to see whether it readily wets out and sinks to the bottom of the container. If it does not wet out readily, it is observed whether some or all of the oil reamins on the surface of the water. If some oil remains on the fabric, the specimen is swirled with a stirring rod for 10 seconds, then removed and transferred to a clean paper towel.

If the fabric specimen fails to wet out readily, and tends to float on the surface of the water, a stirring rod is used to immerse the specimen, and the specimen is swirled in the water for 10 seconds, and removed and transferred to a clean paper towel.

The data for this test are given in terms of a rating on a scale of 1–5. The following is an explanation of the meaning of each rating.

If all of the oil is released from the fabric, and floats on the surface of the water, while none of the oil remains on the specimen, and no stirring is needed, the fabric is given a rating of 5.

If some of the oil is released and floats on the surface of the water, while some remains on the specimen, without stirring, the fabric is given a rating of 4.

If all of the oil is released and floats on the surface of the water, while none remains on the specimen, with stirring, the fabric is given a rating of 3.

If some of the oil is released and floats on the surface of the water while some remains on the specimen with stirring, the fabric is given a rating of 2.

If no oil is released to float on the surface of the water and all of it remains on the specimen, the fabric is given a rating of 1.

The results of the tests for the five samples are given in Table 1. Data is given both for unlaundered fabric, and for fabrics which have been machine washed and tumble dried for 10 cycles.

TABLE 1

OIL RELEASE

| SAMPLE # | SAMPLE IDENTIFICATION | UNLAUNDERED | 10 CYCLES Machine Wash/ Tumble Dry |
|---|---|---|---|
| 1 | Caustic Only | 4 | 2 |
| 2 | Milease T only | 5 | 3 |
| 3 | Untreated Control | 1 | 1 |
| 4 | Caustic/Milease T | 5 | 5 |
| 5 | Caustic followed by Milease T in separate baths | 5 | 3 |

It is clear that the fabric treated according to the present invention, Sample #4, has the best oil release properites. While it is true that the fabrics treated with the copolymer (Milease-T) only, or with caustic and Milease-T in separate baths, have excellent oil release properties while unlaundered, the oil release properties of such fabrics deteriorate after laundering. An important consideration in the present invention is that of durability of the properties imparted to the polyester fabric. It is clear that the process according to the present invention imparts oil release properties which remain after the fabric is laundered.

EXAMPLE 7

This example discusses the vertical wick rate test which is used to evaluate the fabric treated according to the present invention. As stated above, in order for a fabric to be useful as an inner garment, it must be capable of carrying away moisture from the skin. That is, the fibers must act as "wicks" which disperse moisture rapidly so that it can be evaporated. The following is a description of a test used on the five samples to determine the speed and effectiveness of wicking.

Two test specimens, each measuring 1"×8", are used. One specimen is not laundered. The other is washed and tumble dried 26 times. Hot water is run over the laundered samples for 10 minutes to remove any detergent which might affect the wicking properties.

A beaker is filled with distilled water to which a small amount of dye is added. The fabric specimen is suspended over the beaker of water so that it comes in contact with the water.

The height to which moisture wicking is observed is measured after 5 seconds, 30 seconds, and 10 minutes.

The results are displayed in Table 2.

TABLE 2

| SAMPLE NUMBER | SAMPLE IDENTIFICATION | Wicking Height, Inches, at different Time Intervals: ORIGINAL UNLAUNDERED 5 sec. | 30 sec. | 10 min. | LAUNDERED & TUMBLE DRIED, 26, CYCLES 5 sec. | 30 sec. | 10 min. |
|---|---|---|---|---|---|---|---|
| 1 | Caustic only | 0.50" | 0.75" | 2.50" | 0.375" | 0.50" | 2.00" |
| 2 | Milease T only | 0.375 | 0.625 | 2.25 | 0.125 | 0.188 | 0.875 |
| 3 | Untreated control | 0.125 | 0.313 | 1.375 | 0.0 | 0.625 | 1.00 |
| 4 | Caustic followed by Milease T in the same bath | 1.0 | 1.25 | 3.50 | 0.50 | 0.75 | 3.00 |
| 5 | Caustic followed by Milease T in separate baths | 0.40 | 0.625 | 2.375 | 0.375 | 0.50 | 2.125 |

It is apparent that the fabric treated according to the present invention is considerably superior to all of the other samples, both with respect to the original fabric, unlaundered, and for the fabric which has been laundered 26 times. For each given time interval, the height to which the water wicks is greater for the sample treated according to the present invention than for any of the other samples.

EXAMPLE 8

This test shows the tendency of fabrics to cling due to electrostatic charges. The method used is a standard method published in the Technical Manual of the American Association of Textile Chemists and Colorists (AATCC), using Test Method 115–1980. This test is essentially a measurement of the time during which a fabric clings to a metal plate after having been rubbed with a standard rubbing fabric. Of course, the shorter the time, the more desirable the fabric. Tables 3 and 4 illustrate the results obtained by using the AATCC method on fabrics treated according to the procedures of Examples 1–5. The table shows data rubbing with fabrics of both nylon and dacron. Table 3 presents test results for unwashed fabrics. Table 4 contain results for fabrics which were washed and tumble dried ten times.

TABLE 3

| Sample No. | Sample Identification | Rubbing Fabric Type | Average Cling Time, in Minutes: Length Direction | Width Direction |
|---|---|---|---|---|
| 1 | Caustic Only | Nylon | 6.5 | 8.4 |
| | | Dacron | 8.5 | 9.5 |
| 2 | Milease T only | Nylon | 4.0 | 7.2 |
| | | Dacron | 6.2 | 8.8 |
| 3 | Untreated control | Nylon | >10.0 | >10.0 |
| | | Dacron | >10.0 | >10.0 |
| 4 | Caustic followed by Milease T, in same bath | Nylon | 0.0 | 0.0 |
| | | Dacron | 0.0 | 0.0 |
| 5 | Caustic followed by Milease T, in separate baths | Nylon | 6.1 | 7.2 |
| | | Dacron | 8.2 | 8.8 |

TABLE 4

| Sample No. | Sample Identification | Rubbing Fabric Type | Average Cling Times, in Minutes: Length Direction | Width Direction |
|---|---|---|---|---|
| 1 | Caustic only | Nylon | 8.0 | >10.0 |
| | | Dacron | >10.0 | >10.0 |
| 2 | Milease T only | Nylon | >10.0 | >10.0 |
| | | Dacron | >10.0 | >10.0 |

TABLE 4-continued

| Sample No. | Sample Identification | Rubbing Fabric Type | Average Cling Times, in Minutes: Length Direction | Width Direction |
|---|---|---|---|---|
| 3 | Untreated control | Nylon | >10.0 | >10.0 |
| | | Dacron | >10.0 | >10.0 |
| 4 | Caustic followed by milease T, in same bath | Nylon | 3.9 | 5.2 |
| | | Dacron | 4.6 | 6.6 |
| 5 | Caustic followed by Milease T, in separate baths | Nylon | 9.1 | >10.0 |
| | | Dacron | >10.0 | >10.0 |

It is seen that, for unwashed fabrics, fabrics treated according to the present invention have an average cling time of zero, while all the other fabrics cling, on average, for several minutes. After all the fabrics have been washed and dried 10 times, the fabrics treated according to the present invention still outperform all of the other samples, by having the shortest average cling times. Thus, treating a fabric according to the present invention imparts to the fabric a durable antistatic quality.

EXAMPLE 9

This test evaluates the tendency of fabrics to pick up dirt from wash water. That is, the test measures soil redeposition properties.

In this soil redeposition test, about 500 ml of water is heated to approximately 205°–210° F. Approximately 0.1 grams of household detergent are added, and dissolved in the water. The hot detergent solution is poured into a mason jar having a capacity of approximately 800 ml. A 3"×3" pre-soiled cotton flannel swatch is placed against each side of the test specimen. The "sandwich" specimens thus made are inserted into the jar, and the sealed jar is shaken for five minutes.

The specimens are then removed, and the soiled swatches are discarded. The test specimens are rinsed thoroughly in lukewarm water.

The specimens are laid out flat, and rated for soil redeposition properties on a 1 to 5 scale, with the heaviest soiled specimen being given a 1 and the least soiled specimen being rated a 5.

The results obtained are displayed in Table 5 below, for samples which are unlaundered, and for samples which have been machine washed and tumble dried ten times.

TABLE 5

SOIL REDEPOSITION

| Sample No. | Sample Identification | Ratings: Unlaundered | Ratings: Laundered 10 Times |
|---|---|---|---|
| 1 | Caustic Only | 3 | 2 |
| 2 | Milease T only | 5 | 2 |
| 3 | Untreated control | 1 | 1 |
| 4 | Caustic followed by Milease T in same bath | 5 | 4 |
| 5 | Caustic followed by Milease T in separate baths | 4 | 2-3 |

It is seen that the fabric treated according to the present invention has the best soil redeposition ratings. Although Sample No. 2 is of equal quality for an unlaundered fabric, the sample treated according to the invention retains more of its desirable soil redeposition qualities after the specimen has been laundered ten times.

From the data presented in the examples above, it is apparent that the use of the present invention produces unexpected and desirable results. In particular, it is important to note that in every test, Sample No. 4 outperformed Sample No. 5. Sample No. 5, as stated earlier, comprises the mere combination of the two known processes, the caustic treatment and the copolymer treatment. Sample No. 4, however, which was treated according to the present invention, involves the use of caustic and copolymer steps combined according to the procedure of Example 4. It is clear that the combination of these steps, in the manner shown in Example 4, yields a vastly different result from that which would be obtained by a mere combination of the two known processes, as was done in Example 5. And of course, the data also show that Sample No. 4 easily outperforms the remaining samples in each of the tests.

A fabric treated according to the present invention suffers no increase in flammability. In fact, fabrics so treated can pass the federal test for children's sleepwear flammability (Standard No. FF3-71).

Because of the excellent soil release properties of fabrics treated by the invention, it is not always necessary to wash such fabrics in hot water. (Recall that, in Example 6, the soil release test, the water had a temperature of only 70°-80° F.) Thus, fabrics treated according to the invention save energy, because they do not always need to be washed in hot water.

Another feature of fabrics treated by the invention is the softness of such fabrics. The use of the caustic treatment causes enough of the fabric to be eaten away so that the fabric tends to feel like fine silk. This effect is in addition to the softening effect of the copolymer treatment.

The description of the process given above is intended to be illustrative and not limiting. Various modifications could be made to the invention without departing from its teachings. For example, the choice of the quaternary compound, used in the caustic treatment steps, could be altered. The choice of copolymer is likewise not limited to the specific brand name mentioned above. And the auxiliary chemicals mentiond in the examples can be varied in many ways. If dyes are used, any dyes suitable for polyester would be acceptable. All these modifications are intended to be included within the scope of the following claims.

What is claimed is:

1. A process for imparting improved soil-release, moisture-wicking, soil-redeposition, and anti-static properties to a polyester fabric, comprising the steps of:

immersing the polyester fabric in an alkaline bath, adjusting the pH of the alkaline bath to a value of 5.5 or less, and adding to said bath a polyester copolymer, said copolymer comprising an aqueous dispersion of 10-50% by weight ethylene terephthalate units, 50-90% by weight polyoxyethylene terephthalate units, wherein the average molecular weight of the polyoxyethylene units is 1000-4000, wherein the molar ratio of ethylene terephthalate to polyoxyethylene terephthalate is in the range of 2:1 to 6:1, wherein the viscosity ratio of the copolymer is between 1:10 and 1.50, and wherein the melting point of the copolymer is above 100° C. as measured by the temperature of disappearance of birefringence.

2. The process of claim 1, wherein the immersing step comprises first adding a catalyst for increasing the affinity of the fabric for the alkaline substances present in the bath.

3. The process of claim 2, wherein the catalyst comprises a quaternary ammonium compound.

4. The process of claim 3, wherein the quaternary compound is cetyl dimethyl ammonium chloride.

5. The process of claim 2, wherein the pH is adjusted to lie within the range of 4.5-5.5

6. The process of claim 5, wherein the pH is adjusted to be substantially 5.0.

7. The process of claim 2, wherein one constituent of the copolymer comprises a polyester.

8. The process of claim 7, further comprising the steps of dyeing and rinsing the fabric.

9. The process of claim 8, wherein the alkaline bath comprises a substance selected from the group consisting of sodium hydroxide and potassium hydroxide.

10. The process of claim 9 wherein the dyeing step comprises adding a carrier, at least one leveling agent, and dye stuff.

11. A process for improving the moisture-wicking, soil-release, soil-redeposition, and anti-static characteristics of a polyester fabric, comprising the steps of:

immersing a polyester fabric in a bath containing sodium hydroxide, neutralizing the sodium hydroxide, adjusting the pH of the bath to lie within the range of 4.5-5.5, adding to the bath a polyester copolymer comprising an aqueous dispersion of 10-50% by weight ethylene terephthalate units, 50-90% by weight polyoxyethylene terephthalate units, the average molecular weight of the polyoxyethylene units being 1000-4000, the molar ratio of ethylene terephthalate to polyoxyethylene terephthalate being in the range of 2:1 to 6:1, the viscosity ratio of the copolymer being between 1.10 and 1.50, and the melting point of the copolymer being above 100° C. as measured by the temperature of disappearance of birefringence, and exhausting the polyester copolymer onto the fabric.

12. The process of claim 11, wherein the immersing step is preceded by treating the fabric with a quaternary ammonium compound.

13. The process of claim 12, further comprising adding to the bath a carrier, at least one leveling agent, and dye stuff.

14. The process of claim 13, wherein the adjusting step comprises adjusting the pH to be substantially 5.0.

* * * * *

UNITED STATES PATENT OFFICE

CERTIFICATE OF CORRECTION

Patent No. 4,370,143 Dated January 25, 1983

Inventor(s) Jackson Bauer

It is certified that error appears in the above-identified patent and that said Letters Patent are hereby corrected as shown below:

Column 9, line 39 after the word data the word "after" is omitted.

Column 9, line 41 "contain" should be --contains--

Column 10, line 29 "milease" should be --Milease--

Signed and Sealed this

Fourteenth Day of June 1983

[SEAL]

*Attest:*

DONALD J. QUIGG

*Attesting Officer*

*Acting Commissioner of Patents and Trademarks*